US006334882B1

(12) United States Patent
Åslund

(10) Patent No.: US 6,334,882 B1
(45) Date of Patent: Jan. 1, 2002

(54) DENSE PARTS PRODUCED BY UNIAXIAL COMPRESSING AN AGGLOMERATED SPHERICAL METAL POWDER

(75) Inventor: Christer Åslund, Torshälla (SE)

(73) Assignees: Scandinavian Powdertech AB, Torshalla (SE); Metals Process Systems, Boulogne-Billancourt (FR)

( * ) Notice: Subject to any disclaimer, the term of this patent is extended or adjusted under 35 U.S.C. 154(b) by 0 days.

(21) Appl. No.: 09/600,119

(22) PCT Filed: Jan. 12, 1999

(86) PCT No.: PCT/SE99/00024

§ 371 Date: Jul. 12, 2000

§ 102(e) Date: Jul. 12, 2000

(87) PCT Pub. No.: WO99/36214

PCT Pub. Date: Jul. 22, 1999

(30) Foreign Application Priority Data

Jan. 13, 1998 (SE) ..... 9800073

(51) Int. Cl.[7] ..... B22F 3/12
(52) U.S. Cl. ..... 75/228; 419/38; 419/65
(58) Field of Search ..... 75/228; 419/38, 419/65

(56) References Cited

U.S. PATENT DOCUMENTS

| | | | | |
|---|---|---|---|---|
| 5,460,641 A | | 10/1995 | Åslund | 75/255 |
| 5,972,284 A | * | 10/1999 | Lindsten et al. | 419/2 |
| 6,261,496 B1 | * | 7/2001 | Duyckinck et al. | 264/118 |

FOREIGN PATENT DOCUMENTS

| | | |
|---|---|---|
| DE | 4027887 | 3/1992 |
| EP | 0029389 | 5/1981 |

* cited by examiner

*Primary Examiner*—Ngoclan Mai
(74) *Attorney, Agent, or Firm*—Rothwell, Figg, Ernst & Manbeck

(57) ABSTRACT

The invention refers to a process for compressing a spherical metal powder, agglomerated with at least 0.5% by weight of a thermo-reversible hydrocolloid as a binder, in a uniaxial press operation with a ram speed of over 2 m/s to a green body having a high density. More particularly the invention also refers to a process for sintering said green bodies to products with full or near full density. The products obtained can be high resistant, high strength details or parts of stainless steel or other alloys.

14 Claims, No Drawings

DENSE PARTS PRODUCED BY UNIAXIAL COMPRESSING AN AGGLOMERATED SPHERICAL METAL POWDER

The present invention refers to a process for production of high density sintered parts from spherical metal powders, as well as to the sintered parts obtained by said process.

BACKGROUND OF THE INVENTION

Powder metallurgical processes, such as sintering, allow the production of complicated details almost without subsequent machining and is therefore an advantageous method for making small and medium sized structural parts or components.

It is well known that spherical powders made from gas atomizing a liquid melt in an inert atmosphere yield a powder with high purity. If such a powder for example of a stainless steel or a nickel base alloy is densified at high temperature to full density, the result is an excellent product with properties in many cases superior to wrought products. There are some known techniques to produce such products for example Hot Isostatic Pressing (HIP) and Metal Injection Moulding (MIM). The first mentioned technique, HIP, where you use mainly metallic capsules to enclose the powder body, is mainly suitable for bigger objects for economical reasons. The powder has to be encapsulated before the pressing and after the pressing process machining will be required to remove the capsule which has been attached to the pressed powder material. The second process, MIM, is suitable for small objects, usually of a very intricate form, up to a maximum of 1 kg, but this process is rather expensive due to the requirement of finer powders and long process times. This process also requires that the powder is mixed with for instance a plastic material before extrusion. The plastic material has to be removed before sintering giving a green body of a low density. Due to the above mentioned reasons the MIM process therefore is mainly used when small parts of very complicated shape can replace extensive machining.

It is known that you can reach very interesting results in material working, like for example cropping of steel bars, cutting blanks in steel sheath etc., by using so called high speed forging presses. This technique was developed in the early 60's even if the fundamentals were known since the 40's, to be used to cut small diameter bar into blanks for further processing, like for example valve heads for engine valves in automobile industry which are produced in many millions around the world and which require a process with high production capacity as well as high yield in the cropping process.

With high speed presses for cropping or blanking we mean presses with ram speeds, that is tool speeds, over approximately 3–4 m/s and preferably higher. In this type of process, for example when cropping the above mentioned small bars, you get a phenomena called adiabatic heating, which can be explained as follows: When a material is deformed this is done in distinct planes and directions, so called shear planes or shear bands. In these planes a part of the deformation energy subjected to the body is transformed to heat energy. If now the deformation energy is applied to a massive body fast enough, the shear planes will momentarily by heated to a high temperature, so called adiabatic heating, and the material will be sheared off along this plane. If the deformation speed is too low, the heat conductivity will more and more reduce the effect of adiabatic heating resulting in cut off blanks with rugged surfaces and cracks etc., and with uneven tolerances. This is known technique.

In uniaxial powder pressing, you use traditionally slow going hydraulic presses where in a closed tool irregular powders are compressed into blanks which are then sintered to obtain better mechanical properties. For standard powders like carbon steel and stainless steel you never reach full density, so the end product is porous and the usage potential is therefore limited. However, uniaxial pressing is a very efficient production technique to make near net shape products and it would therefore be very interesting if you could find a method to reach full density products having the same properties as wrought products. In uniaxial pressing one of the limiting factors is the maximum surface pressure in the tools and this limit is usually practically in the area of 700–800 N/mm$^2$. For these standard powders you get some improvement by heating the whole powder mass before introducing the powder mass into the tool, so called warm compaction process, which has been introduced during the last few years. You get some improvements in green density, but they are not very dramatic and especially on high alloyed material, like stainless steel, the effect is negligible.

Some tests of high speed pressing have been made with these types of irregular powders but no significant effect has been seen regarding improvement in density or mechanical properties. This is probably due to the fact that irregular powders due to their shape have a limited ability to shrink, as well as a high level of oxygen in the form of oxides on the surfaces, and other impurities.

Spherical metal powders produced by gas atomization suffer from low green strength after uniaxial compaction. In contrast the irregular metal powders produced by water atomization provide excellent green strength, but are heavily oxidized during production and said oxide films are hindering the subsequent sintering. U.S. Pat. No. 5,460,641 discloses a process for the preparation of an agglomerated metallic powder capable of sintering after cold compression forming, wherein spherically shaped metallic particles are mixed with an aqueous solution of gelatine to a pasty mixture which is granulated and dried. After cold compression of the agglome-rated metallic powder in a mould a green body is obtained having a mechanical strength which is superior to that obtained with the initial metallic particles and sufficient for handling and subsequent sintering. This process can be used for producing low density sintered parts from spherically shaped metallic particles.

The object of the present invention is therefore to provide a process that overcomes the drawbacks of the above mentioned methods giving high density green bodies with even better green strength, which subsequently can be sintered to high density metal parts.

DESCRIPTION OF THE INVENTION

Surprisingly it has now been found that fully or near fully dense products can be obtained from agglomerated spherical metal powders by means of high speed pressing and subsequent sintering. By using said process products of complicated shape can be obtained without the need for extensive machining. The products obtainable from the process according to the present invention have improved strength properties and can be used in very demanding environments.

The present invention refers to a process for compressing an agglomerated spherical metal powder comprising at least 0.5% by weight of a thermo-reversible hydrocolloid as a binder, which is characterized in that the agglomerated spherical metal powder is pressed in an uniaxial press operation with ram speed of over 2 m/s to a green body having a high density.

The present invention also refers to a process for the preparation of a sintered product from agglomerated spherical metal powder comprising at least 0.5% by weight of a thermo-reversible hydrocolloid as a binder, wherein the agglomerated spherical metal powder is pressed in an uniaxial press operation with a ram speed of over 2 m/s to a green body, and said green body is subsequently sintered to full or near full density.

The spherical metal powder to be compressed and optionally sintered is preferably a gas atomized metal powder, but can also be a spherical metal powder obtained in any other conventional way, such as by chemical or electrolytical precipitation. The metal powder can be a powder of a carbon steel or stainless steel, or any other high melting alloy based upon nickel, iron or cobalt. The alloy may also comprise other elements in smaller amounts, e.g. carbon, chromium, molybdenum, copper, nitrogen, vanadium, sulphur, titanium and niobium. Alloys based on tantalum or wolfram are, however, not suitable as having a too high melting point, about 3000° C. The expression "spherical metal powder" as used in the this context refers in addition to spherical also to near spherical metal powders, for instance of an oval shape.

Thermo-reversible hydrocolloids refer to hydrophilic colloidal materials which are characterized by a heat reversible gelling and softening which can be controlled by cooling and heating, respectively. Specific examples of such thermo-reversible hydrocolloids are slightly esterfied pectins, κ-carrageenan and gelatines. Further examples of said hydrocolloids are described in the publication Hydrocolloides, edited by Mero Rousselot Satia, Paris. In order to agglomerate the metal powder the binder is preferably added to the spherical metal powder in the form of an aqueous solution. The amount of binder in the agglomerated powder should normally be higher than 0.5% by weight as the binding properties are not sufficient below 0.5%. The amount of binder in the agglomerated powder should not be too high as this might cause problems when the binder is removed. A preferred upper limit is 1.5% by weight. According to a preferred process gelatine is used as a binder. Further details of the agglomeration process using gelatine as a binder are described in the U.S. Pat. No. 5,460,641. The gelling process, which normally occurs between 40 an 80° C. when using gelatine, should consequently be reversible unlimited times.

The uniaxial press operation is a process where you use a tool which preferably is closed, for compressing the agglomerated spherical-metal powder in one single direction. The tool should be operating with a ram speed over 2 m/s whereby a green body is formed. The ram speed is according to a preferred embodiment of the invention 4 m/s or higher, e.g. 4–7 m/s. The high ram speed gives a pre-sintering product, that is a green body, having a high green density. The upper limit for the ram speed is determined by the strength of the tool. When too high a speed is used, the tool will disintegrate and fall into pieces. The pressure is in general 400–800 N/mm$^2$. When the binder is gelatine the uniaxial press operation is preferably performed at a temperature ranging from 40° C. to 55° C., most preferred from 45° C. to 50° C.

The sintering of the green body takes place at a sintering temperature, which depends on the composition of the metal powder, and in a controlled atmosphere. The optimum temperature can be determined by conventional means, for example by using a software called Thermo-calc. The sintering temperature for steel powders and powders of high melting alloys will in general be within the range of 1100–1350° C. and 1350–1550° C., respectively. A stainless steel can for instance be sintered at 1350° C. for 2 to 3 hours. The sintering normally takes place in vacuum or in a reducing or inert gas, preferably in hydrogen. The sintering gives a final product with full or near full density. Before the sintering the binder is removed by preheating in air at a temperature of 300 to 500° C.

According to a preferred embodiment, the sintered product is subsequently subjected to hot isostatic pressing (HIP) without being encapsulated, whereby a product,of a guaranteed 100% density can be achieved.

The invention also refers to a sintered product obtained from an agglomerated spherical metal powder comprising at least 0.5% by weight of a thermo-reversible hydrocolloid as a binder by pressing the agglomerated spherical metal powder in an uniaxial press operation with a ram speed of over 2 m/s to a green body, and subsequently sintering said green body to full or near full density. In accordance with preferred embodiments of the invention the ram speed of the press during the pressing operation is 4 m/s or-higher, the amount of binder in the agglomerated powder does not exceed 1.5% by weight, and the thermo-reversible hydrocolloid is gelatine.

The invention also refers to a sintered product as well as to a green body obtainable from the processes described above. The yield of the process is over 98%.

The sintered products of the invention can be used for production of high strength, non-oxidising, corrosion resistant or fire proof products. Examples of such products are filters, gear box parts, such as high torque gear box parts, engine parts, fasteners, watch cases, valve parts like gates, and other details.

The following non-limiting examples describe the characteristics of the process for producing green bodies and subsequently sintered products, and especially the properties of the products of the invention compared to similar products produced in a conventional way.

EXAMPLE 1

Agglomerated powder of stainless steel AISI 316 with a binder content of 1.5% by weight of gelatine, as described in the above mentioned patent U.S. Pat. No. 5,460,641, was used. This powder was used for making blanks by uniaxial pressing in a mould with a diameter of 40 mm. The powder weight was 22 grams.

The first sets of pressings were made in a conventional hydraulic press with a ram speed of max. 1 m/s and with a specific max. tool pressure of 800 N/mm$^2$, which is a practical limit for cemented carbide tools. The green density of the compressed specimens was in average 86.5% of the theoretical density.

The second sets of pressings were made in a high speed press with a ram speed of 4 m/s. The total energy released was 2300 Nm; within the tool speed range the energy is controlled by the speed and the weight of the moveable tool. The green density of the compressed specimens was in average 92.5%.

After this initial step, the two groups of blanks or green bodies were annealed in dry hydrogen at 1350° C., which is a standard high temperature sintering operation for stainless steel. After sintering the density was measured again. The low speed pressed products had a density of 95.5%, while the high speed pressed products had a density of 99.7%. Micrographs of the low density products revealed numerous pores while the high dense products showed only a few very s mall, isolated pores, but in principle a fully dense product.

The two types of products were tested in mechanical testing and gave the following result:

| | |
|---|---|
| Low speed pressing | |
| Yield strength | 155.4 MPa |
| Rupture strength | 375.2 MPa |
| Elongation | 32% |
| High speed pressing | |
| Yield strength | 235.4 MPa |
| Rupture strength | 485.6 MPa |
| Elongation | 58% |

The low speed pressed products had mechanical properties fulfilling ASTM standards B 525 for conventionally sintered pressed material, but did not fulfil the requirements for wrought products. To the contrary the high speed pressed products fulfilled in all means the required properties for wrought products.

EXAMPLE 2

Agglomerated spherical powder of a low alley carbon steel with 0.12% carbon was used for this test. The powder was soft annealed before agglomeration to reach a good ductility at pressing. The powder was agglomerated as mentioned above but with a binder content of 0.75% by weight. The same operations were performed as in Example 1 giving a green density of 91.2% for the low speed pressed part and 95.2% for the high speed pressed part. The green products were measured according to a standard green strength test (EN 23995) and gave a value of 2.5 MPa for the low speed pressed and 9.4 MPa for the high speed pressed part. As a rule of thumb the green strength should exceed 4 MPa for the green body to be considered to be safe to handle. Obviously the green strength of the low speed pressed part is too low for safe handling of complicated green bodies.

The parts were annealed in vacuum at 1250° C. After sintering the density was measured again. The low speed pressured product had a density of 96.5% while the high speed pressed product had a density of 99.8%. The two types of products were tested in mechanical testing and the following results were obtained:

| | |
|---|---|
| Low speed pressing | |
| Yield strength | 175.2 MPa |
| Rupture strength | 372.5 MPa |
| Elongation | 14% |
| High speed pressing | |
| Yield strength | 235.0 MPa |
| Rupture Strength | 385.3 MPa |
| Elongation | 28% |

The low speed pressed products do not fulfil the standards for to wrought products while the high speed pressed products fulfil the requirements.

EXAMPLE 3

A new test was made as in Example 2, wherein the ram speed of the high speed press was decreased to 1.5 m/s maintaining the total energy supplied in the operation by increasing the total weight of the movable tool. In,this case the following result were obtained after the subsequent sintering.

| | |
|---|---|
| High speed pressing | |
| Yield strength | 185.6 MPa |
| Rupture strength | 366.0 MPa |
| Elongation | 18% |

These values do not fulfil the international standards for wrought material for these types of material.

In the above examples it has been clearly shown that when high speed pressing of spherical agglomerated powder is used as described above, the product obtained after sintering will get strongly improved mechanical properties compared to a low speed pressed product. This difference in properties is of utmost importance in products which are subjected to high stresses or due to corrosion requirements need to be fully dense. It is also important that the green density is as high as possible to give minimum shrinkage during sintering.

It is not easily understood why these surprising results are achieved, but one explanation could be that the mixture of binder and powder acts like a high viscous fluid during the high speed pressing, reducing the amount of energy required for densification, and giving this unique high green density. The scope of the present invention should however not be limited by this in any way. A number of modifications in press parameters and sintering parameters for the agglomerated spherical powders can be made, which are obvious for a person skilled in the art. These variants and modifications also form part of the present invention.

What is claimed is:

1. A process for compressing an agglomerated spherical metal powder including at least 0.5% by weight of a thermo-reversible hydrocolloid as a binder, comprising:

pressing the agglomerated spherical metal powder in a uniaxial press operation with a ram speed of over 2 m/s to a green body having a high density.

2. A process according to claim 1, wherein the ram speed of the press during the pressing operation is 4 m/s or higher.

3. A process according to claim 1 or 2, wherein the amount of binder in the agglomerated metal powder does not exceed 1.5% by weight.

4. A process according to claim 1, wherein the thermo-reversible hydrocolloid is gelatine.

5. A process according to claim 4, wherein the uniaxial press operation is performed at a temperature ranging from 40° C. to 55° C.

6. A process according to claim 1, further comprising sintering said green body to full or near full density to form a sintered product.

7. A process according to claim 6, wherein the sintered product is subsequently subjected to hot isostatic pressing without being encapsulated.

8. A sintered product comprising an agglomerated spherical metal powder including at least 0.5% by weight of a thermo-reversible hydrocolloid as a binder, the agglomerated spherical metal powder being pressed in a uniaxial press operation with a ram speed of over 2 m/s to a green body that is subsequently sintered to full or near full density.

9. A sintered product according to claim 8, wherein the ram speed of the press during the pressing operation is 4 m/s or higher.

10. A sintered product according to claim 8 or 9, wherein the amount of binder in the agglomerated spherical metal powder does not exceed 1.5%.

11. A sintered product according to claim 8, wherein the thermo-reversible hydrocolloid is gelatine.

12. A green body formed by the process according to any of claims 1, 2, 4, or 5.

13. A process according to claim 5, wherein the uniaxial press operation is performed at a temperature ranging from 45° C. to 55° C.

14. A green body formed by the process of claim 1, wherein the amount of binder in the agglomerated metal powder does not exceed 1.5% by weight.

* * * * *